United States Patent [19]

Mailliet et al.

[11] 4,058,300

[45] Nov. 15, 1977

[54] CLAY GUN

[75] Inventors: Pierre H. Mailliet, Howald; Jean Metz, Luxembourg, both of Luxembourg

[73] Assignee: S.A. des Anciens Etablissements Paul Wurth, Grand Duchy, Luxembourg

[21] Appl. No.: 702,120

[22] Filed: July 2, 1976

[30] Foreign Application Priority Data

July 4, 1975 Luxembourg ..... 72902

[51] Int. Cl.[2] ..... C21B 7/12

[52] U.S. Cl. ..... 266/273

[58] Field of Search ..... 266/272, 273; 92/168

[56] References Cited

U.S. PATENT DOCUMENTS

| | | | |
|---|---|---|---|
| 2,062,860 | 12/1936 | Brosius | 266/273 |
| 3,188,923 | 6/1965 | Mandelko | 92/168 |

*Primary Examiner*—Gerald A. Dost

[57] ABSTRACT

The efficiency of operation of a taphole plugging clay gun for a blast furnace is enhanced by facilitating the cleaning of the sealant receiving chamber thereof behind the ejector piston which moves therein. Cleaning is facilitated by providing a protective casing which defines an annular chamber into which sealant leaking past or falling behind the ejector piston is forced; the annular chamber being provided with cleaning ports in the side wall.

9 Claims, 1 Drawing Figure

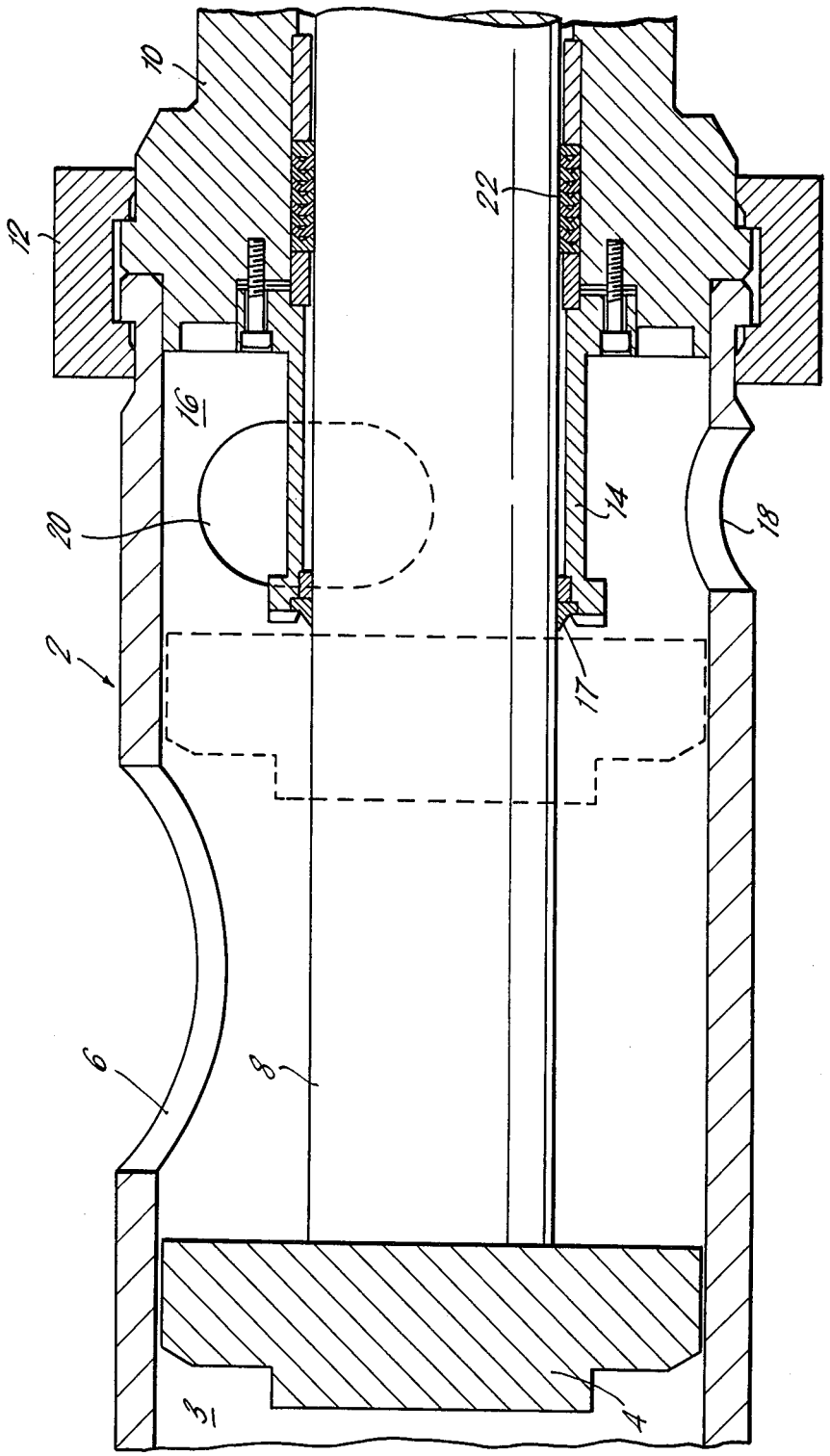
10
12
22
16
20
14
18
2
17
6
8
4
51

CLAY GUN

BACKGROUND OF THE INVENTION

1. Field of the Invention

The present invention relates to the plugging of tapholes in furnaces such as, for example, blast furnaces employed in the production of steel. More specifically, this invention is directed to an improved apparatus for sealing the pouring holes of shaft furnaces. Accordingly, the general objects of the present invention are to provide novel and improved methods and apparatus of such character.

2. Description of the Prior Art

While not limited thereto in its utility, the present invention is particularly well suited for use in sealing the pouring holes of a shaft furnace. Such taphole plugging or sealing devices are known in the art as "clay guns." For a general discussion of the operation of clay guns, reference may be had to U.S. Pat. No. 3,765,663 which is assigned to the assignee of the present invention.

The tapholes of a shaft furnace are plugged by injecting thereinto, at very high pressure, a sealing compound which generally consists of clay. The clay injecting mechanism or clay gun is provided with a hydraulic jack which actuates an ejector piston. The clay ejector piston of the clay gun slides within a clay chamber and serves to remove material supplied to this chamber via a "nose" which is inserted into the furnace taphole. Modern blast furnaces operate at very high counterpressures and thus, as noted above, the sealing compound must be ejected from the clay gun at a high pressure. The requisite high sealing compound ejection pressure can be obtained only by actuating the ejector piston of the clay gun by means of a hydraulic jack.

The loading of a clay gun typically comprises a plurality of repetitive steps wherein slugs or piles of sealing compound are delivered to the clay chamber through an aperture and individually moved forward to permit the delivery of additional material to the chamber. The sealing compound or clay is delivered to the clay chamber when the ejector piston is in the retracted position and when the clay gun is positioned in a substantially horizontal plane. The clay, because of its physical nature, has a tendency to accumulate beneath the loading aperture or port and obstructs this aperture. In order to clear the obstruction, and thus continue the chamber loading process, the ejector piston is operated to force the sealing compound towards the nose of the clay gun. After the ejector piston has been returned to its retracted position, further sealing compound can be introduced into the clay chamber and this operational sequence is repeated until the clay chamber has been filled.

During the clay gun loading operation, some of the taphole sealing compound may fall from the vicinity of the loading aperture into the clay chamber on the rod side of the ejector piston. This material will then be moved toward the rear of the clay chamber when the ejector piston is retracted. There will, additionally, be some leakage of sealing compound around the ejector piston. The sealing compound introduced into the clay gun contains abrasive particles which could easily damage the surface of the ejector piston rod, which is usually chromium, and which could also be transported on the rod into the hydraulic jack thereby scoring sealing surfaces. In order to prevent any appreciable quantity of taphole sealing compound, hereinafter called the "clay," from accumulating on the rod side or "upstream" of the ejector piston, frequent cleaning of the clay gun must be performed. This cleaning insures that the movements of the ejector piston will not be impeded and also prevents rapid wear of the piston rod and the sealing surfaces and packings of the hydraulic jack. Damage to the surface of the ejector piston rod or the sealing surfaces of the hydraulic jack would result in leakage of hydraulic fluid which must, to the extent possible, be avoided.

The cleaning of prior art clay guns, to remove material which gets behind the ejector piston, is a difficult task since the clay chamber at the rod side of the ejector piston is not readily accessible. The difficulty incident to the cleaning procedure is heightened because of the precautions which must be taken in order to assure that the piston rod will not be damaged by the cleaning tools.

SUMMARY OF THE INVENTION

The present invention overcomes the above briefly discussed and other deficiencies and disadvantages of the prior art by providing a novel technique and apparatus which facilitates the removal, from the chamber of a clay gun on the piston rod side of the ejector piston, of any sealing material which leaks past or otherwise becomes trapped behind the clay gun ejector piston. Apparatus in accordance with the present invention includes, within the clay chamber of a clay gun at the piston rod side of the ejector piston, a member which cooperates with the ejector piston and head of the hydraulic cylinder to define an annular chamber with the ejector piston in its retracted position. This annular chamber is provided with at least one exit or cleaning aperture in its exterior wall. The annular chamber defining member also functions as a stop to limit the motion of the ejector piston in the retraction direction.

BRIEF DESCRIPTION OF THE DRAWING

The present invention may be better understood and its numerous objects and advantages will become readily apparent to those skilled in the art by reference to the accompanying drawing which is a schematic partial side elevation view of a clay gun incorporating a preferred embodiment of the present invention.

DESCRIPTION OF THE PREFERRED EMBODIMENT

With reference now to the drawing, a clay gun is indicated generally at 2. The nose or nozzle of the clay gun, not shown, would be to the left as the device is depicted. The hydraulic jack, which supplies the force for actuating the clay gun, has also been omitted from the drawing but would be positioned to the right as the device is depicted. The clay gun includes a cylindrical clay chamber 3 and an ejector piston 4 which moves therein. The piston 4 has been shown in an extended position in solid lines and in its fully retracted position in broken lines. Clay is introduced into chamber 3 via a loading port or aperture 6 when the piston 4 is in the retracted position. The piston 4 is affixed to the end of a piston rod 8 which is actuated by the hydraulic jack; the head of the hydraulic jack being indicated at 10. The clay chamber 3 thus constitutes a prolongation of the hydraulic jack with the chamber and jack being coaxial and being interconnected by means of a collar or bracket 12.

The piston 4 and piston rod 8 may be operated in either a taphole sealing mode or a clay chamber loading mode. In the loading mode the piston 4 is cycled so as to repetitively push slugs or piles of clay delivered to chamber 3 via port 6 toward the nose of the clay gun until a sufficient quantity of clay is present in chamber 3 in front of piston 4. During the plugging mode the piston causes the clay to be ejected from clay chamber 3 through the nose of the clay gun 2.

When clay is introduced into chamber 3 through the port 6 it accumulates beneath this aperture in front of the piston 4. The clay delivered to chamber 3 through port 6 during a filling operation will generally extend upwardly into the void left by the formation of port 6. When the piston 4 is actuated to force a pile of clay toward the front or nose end of chamber 3, a quantity of clay will often fall from the circular port into chamber 3 on the rod side of piston 4. Accordingly, after each step of the charging sequence, the piston 4 may force a quantity of clay in the opposite direction; i.e., toward the right as the apparatus is shown in the drawing. The clay dropping into the chamber behind the piston, as well as any clay which leaks past piston 4, must be regularly removed from the chamber by means of rods, scrapers or other suitable instruments. During this removal or cleaning operation care must be taken to avoid damage to the chromium surface of the piston rod 8.

In accordance with the present invention, in order to facilitate the operation of removing clay from chamber 3 on the piston rod side of ejector piston 4, without any risk of damage to the surface of the piston rod 8, a protective casing 14 is mounted, by any appropriate means, to the head 10 of the hydraulic jack. Casing 14 is of tubular construction and extends outwardly from head 10 into the clay chamber coaxially therewith. The piston rod 8 moves within casing 14. The forward or free end of casing 14 limits the retraction motion of piston 4 by fixing the fully retracted position of the piston. With piston 4 fully retracted, as shown in broken lines in the drawing, an annular chamber 16 is defined between casing 14 and the wall of chamber 3; the ends of this annular chamber being defined by the rear face of piston 4 and the front face of the hydraulic jack. The wall of clay chamber 3 is provided, in the region of annular chamber 16, with at least one and preferably with a number of large apertures. In a preferred embodiment three apertures, only two of which 18 and 20 are shown, were provided. These apertures enable cleaning tools to be introduced into chamber 3 without difficulty for the purpose of detaching and removing the clay which has gotten behind piston 4. Casing 14 prevents any contact between these cleaning tools and the piston rod 8. The apertures in the region of the annular chamber 16 are preferably offset from one another by 60° with one of the apertures being at the bottom of the clay gun to facilitate removal of material from chamber 16. A clay scraper 17, which in the prior art has been positioned in the head 10 of the hydraulic jack, is mounted at the forward or free end of casing 14 in accordance with the preferred embodiment of the present invention.

The provision of annular chamber 16 insures that clay which in any manner gets behind piston 4 will not be compressed between the rear face of the piston and the front face of the hydraulic jack when the piston is retracted. The casing 14, which defines chamber 16, insures that there will be no damage to the piston rod during the cleaning and clay removal operations.

While a preferred embodiment has been shown and described, various modifications and substitutions may be made thereto without departing from the spirit and scope of the invention. Accordingly, it will be understood that the present invention has been described by way of illustration and not limitation.

What is claimed is:

1. In an apparatus for plugging tapholes in a blast furnace, the taphole plugging apparatus including a hydraulic piston actuator, the improvement comprising:

means defining a taphole sealant receiving cylinder, said sealant receiving cylinder having a side wall and first and second oppositely disposed ends and being provided at the first end with a sealant ejection port;

means for delivering sealant to the interior of the cylinder of said sealant receiving cylinder defining means, said delivering means including a supply port in the side wall of said cylinder defining means, said supply port being displaced from the ejection port;

ejector piston means disposed within the cylinder of said sealant receiving cylinder defining means, said piston means including a piston movable to either side of said delivering means supply port;

piston rod means extending into the cylinder of said sealant receiving cylinder defining means through the second end of said cylinder, said rod means coupling said ejector piston means to the hydraulic actuator whereby the actuator controls the movements of said piston means;

casing means extending into the cylinder of said sealant receiving cylinder defining means from the second end thereof, said casing means being coaxial with and located exteriorly of said piston rod means, said casing means cooperating with the inner surfaces of the side wall and the second end of said cylinder to define an annular recess at the second end of said cylinder, a rearwardly facing surface of said piston means piston closing the end of said annular recess when said piston means is at its limit of movement toward the sealant receiving cylinder second end; and means for removing sealant from the annular recess defined in part by said casing means, said removing means including at least a first aperture located entirely in the portion of the side wall of said cylinder which cooperates to define said annular recess.

2. The apparatus of claim 1 wherein the second end of said sealant receiving cylinder is defined by an end of the hydraulic actuator and wherein said casing means includes:

a tubular member; and bolt means for affixing a first end of said tubular member to the hydraulic actuator.

3. The apparatus of claim 2 further comprising:

scraper means affixed to the end of said casing means which faces said ejector piston, said scraper means contacting said piston rod means to remove sealant therefrom where said piston rod means enters said casing means.

4. The apparatus of claim 3 wherein said casing means further includes:

an annular flange disposed about the exterior of said tubular member at the second end thereof, said annular flange defining a circumferential lip extending generally transversely to the axis of said cylinder.

5. The apparatus of claim 2 wherein said casing means further includes:

an annular flange disposed about the exterior of said tubular member at the second end thereof, said annular flange defining a circumferential lip extending generally transversely to the axis of said cylinder.

6. The apparatus of claim 1 wherein said means for removing sealant from the annular recess comprises:

a plurality of circumferentially offset apertures in said cylinder side wall.

7. The apparatus of claim 6 further comprising;

scraper means affixed to the end of said casing means which faces said ejector piston, said scraper means contacting said piston rod means to remove sealant therefrom where said piston rod means enters said casing means.

8. The apparatus of claim 7 wherein said scraper means contacts said piston rod means about the periphery thereof.

9. The apparatus of claim 1 further comprising:

means defining a raised lip about the exterior of said casing means at the free end thereof.

* * * * *